US008899313B2

(12) United States Patent
Pasvandi

(10) Patent No.: US 8,899,313 B2
(45) Date of Patent: Dec. 2, 2014

(54) CUTTING UNIT OF A HYDROMECHANICAL SLOT PERFORATOR

(76) Inventor: Marie Pasvandi, Limassol (CY)

( * ) Notice: Subject to any disclaimer, the term of this patent is extended or adjusted under 35 U.S.C. 154(b) by 0 days.

(21) Appl. No.: 13/984,205

(22) PCT Filed: Feb. 8, 2012

(86) PCT No.: PCT/IB2012/000225

§ 371 (c)(1),
(2), (4) Date: Aug. 7, 2013

(87) PCT Pub. No.: WO2012/107827

PCT Pub. Date: Aug. 16, 2012

(65) Prior Publication Data

US 2013/0312949 A1 Nov. 28, 2013

(30) Foreign Application Priority Data

Feb. 8, 2011 (RU) ..... 2011106442

(51) Int. Cl.
*E21B 43/112* (2006.01)

(52) U.S. Cl.
CPC ..... *E21B 43/112* (2013.01)
USPC ..... 166/55.3; 166/55.2; 166/298

(58) Field of Classification Search
CPC ..... E21B 43/112
USPC ..... 166/55–55.3, 298
See application file for complete search history.

(56) References Cited

FOREIGN PATENT DOCUMENTS

RU 100802 U1 * 12/2010

* cited by examiner

*Primary Examiner* — Giovanna Wright
(74) *Attorney, Agent, or Firm* — Aleksandr Smushkovich

(57) ABSTRACT

A cutting unit for a slot-type perforator is mounted in a casing having a specific edge, driven by a piston or plunger. The cutting unit includes cutting tools associated with a first holder immovable relative to the piston, and a second holder, including a recess, cooperating with the casing's edge, immovable relative to the casing. The holders move relative to each other causing extending and retracting the cutting tools in opposite directions, during piston's movements. The cutting unit includes a retractable mechanism to bring its parts into a transportation position and to fix them therein. The retractable mechanism includes a guide groove made in the second holder, and a connecting rod attached to the first holder. The rod moves through the groove ensuring the return of the second holder into the transportation position, wherein it is fixed absent pressure upon the piston, caused by interaction of the edge and recess.

6 Claims, 1 Drawing Sheet

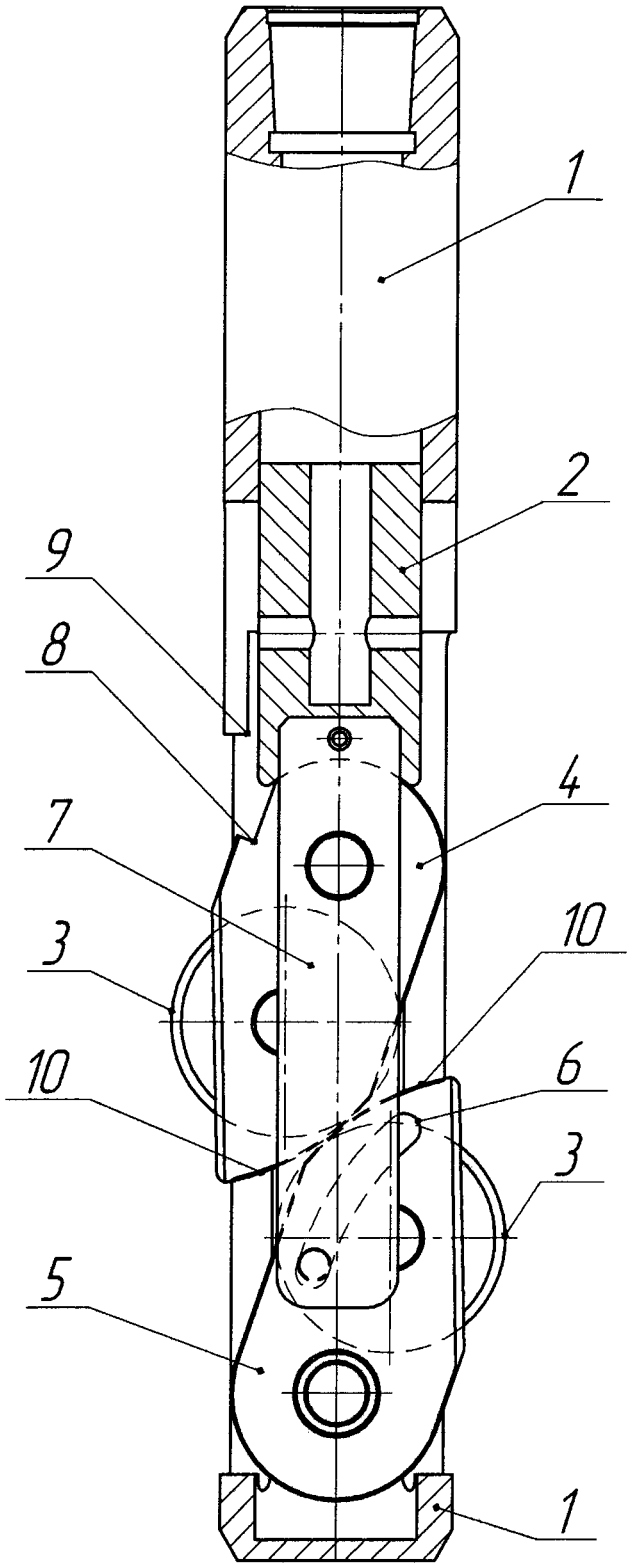
1
2
9
8
4
7
10
3
10
6
3
5
1

CUTTING UNIT OF A HYDROMECHANICAL SLOT PERFORATOR

CROSS-REFERENCE TO RELATED APPLICATIONS

This application is a U.S. national stage application of a PCT application PCT/IB2012/000225 filed on 8 Feb. 2012, published as WO2012107827, whose disclosure is incorporated herein in its entirety by reference, which PCT application claims priority of a Russian Federation patent application RU2011106442 filed on 8 Feb. 2011.

FIELD OF THE INVENTION

The proposed invention relates to drilling and well operations, in particular to the design of devices for the opening of productive layers through a slot perforation, and may be used in the construction and repair of wells for various purposes.

BACKGROUND OF THE INVENTION

In the prior art are known the cutting units of hydro-mechanical slot perforating machines, which include cutting tools enabling to form simultaneously two perforation slots in the production string, with the mechanism of their extension, for example, disclosed in patents RU 2249678 C2, IPC E21B 43/112, Apr. 10, 2005, RU 2371569 C1, IPC E21B 43/112, Oct. 27, 2009, RU 86654 U1, IPC E21B 43/112, Sep. 10, 2009, RU 2348797 C1, IPC E21B 43/112, Mar. 10, 2009. At that the size of cutting tools used in the mentioned designs of the cutting units approaches the diameter of the perforator's casing that allows creating perforations slots of a considerable depth.

The disadvantage of multiple-cutting units is the use of cutting tools extension mechanisms therein, envisaging the presence of a significant distance between the cutting tools in a working position, which conditions a significant height difference of the perforating slots formed simultaneously.

Known is a cutting unit of hydromechanical slot-type perforator disclosed in the patent for utility model RU 100802 U1, IPC E21B 43/112, Dec. 27, 2010, which eliminates the mentioned disadvantage. It is the closest to the present invention and is further referred to as a 'prototype'.

The cutting unit of hydromechanical slot-type perforator of the prototype includes a retractable blades mounted on the axes of the upper and lower holders, installed inside the perforator's casing by means of the fingers, with that the upper holder is mounted on the plunger and the lower holder is secured to the housing, in addition, holders are made flat and located in the same plane with the possibility of deviations in opposite directions at translational impact of the plunger, in addition, working surfaces of the holders interacting with each other are performed at the ends of the holders, rounded, and the lower holder is additionally provided with a supporting surface with the possibility of exposure to the lower spring anchor through the washer, while the lower spring is located in the glass—the tensioner.

Cutting tools of the device, according to the prototype, are mounted at the holders close enough to each other. Advancing in opposite directions during the opposite movement and interaction of the holders, cutting tools perform back-to-radial displacement, and, taking up the operating position, turn out to be approximately at the same level relative to the vertical axis of the perforator. This ensures that the production casing opening with simultaneous formation of two perforating slots with a minimum height difference between them.

The disadvantage of the cutting unit according to the prototype is lack of an effective mechanism to bring the telescoping parts in the initial (transport) position after perforation as well as lack of restraint and fixing devices. Thus, the prototype does not provide any means for the return of the lower cutting disc in the transport position and for fixing it in such position. The upper cutting disc, which rises in the holder together with the piston under conditions of reducing operating pressure, takes up the initial position under the force of its own weight. However, the prototype does not provide the means for holding the top cutting disc in the perforator's housing during its transportation. Given the design features of the cutting unit according to the prototype, it can lead to spontaneous extension of cutting discs out of the case during transportation of the perforator and when it is lowered into the borehole, as well as to inability to remove the device from the well after perforation. In addition, the spontaneous extension of the cutting disc out of the body can cause damage and injury to personnel working with the device.

SUMMARY OF THE INVENTION

The purpose and technical result of the present invention is to improve the reliability and safety operation of a hydromechanical slot-type perforator, improving its performance.

The mentioned technical result is achieved by designing the perforator's cutting unit with a retractable mechanism to bring telescoping parts thereof into a transportation position and to secure them in such position.

A cutting unit of the perforator is mounted in a casing (body); the inventive cutting unit is driven by a piston or plunger; the cutting unit comprises telescoping cutting tools mounted on holders, one of which is fixed relative to the piston (plunger), and the other one is fixed with respect to the casing; wherein the holders are capable of interaction and movement with respect to each other, and capable of extending and retracting the cutting tools in opposite directions during movements of the piston (plunger).

According to the invention, the cutting unit is additionally equipped with a retractable mechanism to bring parts into a transportation position and fix them in such position; wherein the retractable mechanism comprises at least one guide groove made in the holder, fixed in relation to the body, and at least one connecting rod attached to the holder fixed with respect to the piston (plunger), or immediately fixed to the piston (plunger), which connecting rod is capable of moving through the guide groove and thereby ensuring the return of the holder with the guide groove into the transportation position during the reverse movement of the piston (plunger); the retractable mechanism comprises a recess made in the holder fixed with respect to the piston (plunger), wherein the recess is shaped similar to the shape of the casing's edge, with the possibility of fixation of the holder in the casing in the absence of pressure on the piston (plunger) produced due to an engagement (interaction) of the casing's edge with the groove of the holder.

Due to the presence of the groove and the connecting rod, the above described inventive design of the perforator's cutting unit allows, during a reduction of the operating pressure on the piston (plunger), bringing the cutting unit into the transportation position and fixing the cutting tool (such as a cutting disc mounted on the holder fixed relative to the casing) in it; and, due to the presence of the aforementioned special recess in the cutting tool's holder fixed relative to the piston (plunger), the inventive design allows for securely fixing this cutting tool, along with its holder inside the casing. This ensures a reliable fixation of the cutting tools in the perforator's body in the transportation position, which prevents their spontaneous extension.

The cutting unit of the invention may have the following features.

The holders may take the form of wedge-type shackles, made with the ability to turn during the interaction of their tips (that can be configured as V-shaped surfaces) with each other. This form allows to explicitly set the direction for the extension of the holders that is necessary at the beginning of their extension.

The V-surfaces of the wedge-type shackles may have a rounded shape. As a result of the kinematic analysis, it is determined that this form allows keeping an almost constant value of the force aimed at the extension of the holders from the perforator's body at any stage of the extension process.

In addition, the rounded shape of the V-surfaces allows the wedge-type shackles to return gradually to their initial position during a decrease in the intensity of their interaction, at that preventing a jamming of the holders in the working extended position.

The device, according to the present invention, utilizes a variety of cutting tools.

The cutting tools, mounted on the holders, can be made in the form of discs (mills) installed on axles; alternatively they can be made either in the form of cutters, or in the form of knives.

In addition, the cutting tools can be mounted immediately on the holders, for example, in the form of edges of the holders, while the edges are treated in a certain way to acquire cutting properties, for example, sharpened, or fitted with hard alloy inserts.

BRIEF DESCRIPTION OF DRAWING OF THE INVENTION

One of preferred embodiments of the invention is shown in the drawing attached hereto.

DETAIL DESCRIPTION OF A PREFERRED EMBODIMENT OF THE INVENTION

While the invention may be susceptible to embodiment in different forms, there is shown in the drawing, and will be described in detail herein, a specific embodiment of the present invention, with the understanding that the present disclosure is to be considered an exemplification of the principles of the invention, and is not intended to limit the invention to that as illustrated and described herein.

Referring to the drawing, the inventive device comprises a cutting unit of a hydro-mechanical slot-type perforator, which cutting unit is mounted in a casing 1 having an edge 9; the cutting unit is driven by a piston 2; the cutting unit includes telescoping cutting tools 3 furnished with an extension mechanism accomplished in the form of holders 4, 5, one of which 4 is fixed with respect to the piston 2, and the other 5 is fixed with respect to the casing 1. The holders 4 and 5 are executed with the ability to interact and move relative to each other causing the extension and retraction of the cutting tools 3 in opposite directions during movements of the piston 2.

The cutting unit is equipped with a retractable mechanism to bring parts thereof into a transportation position and fix them in such position. The retractable mechanism includes a guide groove 6, made in the holder 5 fixed relative to the casing 1, and a connecting rod 7 attached to the piston 2, while the connecting rod 7 is capable of moving through the groove 6 and thereby ensuring the return of the holder 5 with the groove 6 into the transportation position during the reverse movement of the piston 2; the retractable mechanism also includes a recess 8, being made in the holder 4 fixed relative to the piston 2; the recess 8 is shaped similar to the shape of edge 9 of the casing 1 (allowing for cooperation of these elements), with the possibility of fixation of the holder 4 in the casing 1 in the absence of pressure on the piston 2 caused by the interaction of the edge 9 with the recess 8.

In the embodiment of the invention illustrated in the drawing, the holders 4 and 5 are configured as wedge-type shackles including tips 10 shaped as wedge surfaces (herein also called "V-surfaces"), wherein the shackles are capable of rotation during the interaction of their wedge surfaces 10 with each other. The V-surfaces 10 of the wedge-type holders 4, 5 have a rounded shape. The cutting tools 3 are mounted on the holders 4, 5; in this embodiment, the cutting tools 3 are configured in the form of disks mounted on axles.

OPERATION AND APPLICABILITY OF THE INVENTION

The inventive device operates as follows. Under the influence of an operating fluid, the piston 2 moves progressively along the axis of the perforator, bringing into action the cutting unit's mechanisms. The holder 4, fixed with respect to the piston 2, moves toward the holder 5, fixed with respect to the housing 1. During the contact between the holders 4 and 5, their wedge surfaces 10 interact and move relative to each other. At the same time, the cutting tools 3 placed on the holders 4, 5 are extended in opposite directions, and take up working position. Slot perforation is then executed. After the completion of the perforating slots formation process, and, if necessary to accomplish other downhole operations through the perforator (cavities aggradation, hydrodynamic treatment of formation, acid treatment, etc.), the working pressure drops, the piston 2 performs a reverse motion, regaining its original position. Following the movement of the piston 2, the connecting rod 7, attached thereto, starts the reverse movement through the groove 6 of the holder 5, fixed relative to the casing 1, and puts the holder 5, together with its cutting tool 3, into an initial (transportation) position and fixes them in this position. Following the movement of the piston 2, the holder 4, fixed with respect thereto, also moves into its initial position. When it reaches the edge 9 of the casing 1, the groove 8 of the holder 4 coincides with the edge 9 of the casing 1, and the groove 8 and the edge 9 get engaged with each other. Thus, the holder 4, taking up the transportation position, is fixed inside the casing.

Being brought into the transportation position, the perforator can be extracted from the well or moved to a new perforation interval to continue working without the threat of spontaneous extension of the cutting tools and jamming in the hole.

The invention claimed is:

1. A cutting unit for a hydro-mechanical slot-type perforator having an axis, said cutting unit is mounted in a casing, the casing having an edge with an edge's shape; said cutting unit is associated with and driven by a piston capable of moving in the casing; said cutting unit comprises:

a first holder immovable relative to the piston;

a second holder immovable relative to the casing; the first and the second holders are such configured to provide an interaction with each other during movements of the piston; the second holder includes a recess having a recess' shape capable of cooperation with the edge's shape, thereby providing for fixation of the second holder in the casing absent of pressure applied to the piston during the interaction of the first holder and the second holder;

cutting tools mounted substantially on the first holder and on the second holder; said cutting tools are such configured to provide extending from the axis in opposite directions and retracting thereto during movements of the piston; and a retractable mechanism for bringing said cutting unit into a transportation position and fixing said cutting unit therein; said retractable mechanism including:

at least one guide groove made in the second holder, and at least one connecting rod attached to the first holder; and wherein said connecting rod is configured to move through the groove, thereby ensuring a return of the second holder into said transportation position during a reverse movement of the piston.

2. The cutting unit according to claim 1, wherein the first holder and the second holder are configured as wedge-shaped shackles having V-shaped surfaces capable of cooperation and interaction with each other, thereby causing the first holder and the second holder to turn.

3. The cutting unit according to claim 2, wherein the V-shaped surfaces have a rounded shape.

4. The cutting unit according to claim 1, wherein the cutting tools are mounted immediately on the first holder and the second holder; said cutting tools are represented by: discs or mills mounted on axles, cutters, or knives.

5. The cutting unit according to claim 1, wherein the first holder and the second holder are provided with holder's edges possessing cutting properties; and said holder's edges represent the cutting tools.

6. The cutting unit according to claim 5, wherein said holder's edges are fitted with hard alloy inserts.

* * * * *